United States Patent [19]

Cordes et al.

[11] 4,098,051

[45] Jul. 4, 1978

[54] METHOD AND APPARATUS FOR PACKING A PLURALITY OF SEPARATE ARTICLES, IN A COVER OF SHRINKABLE FOIL

[76] Inventors: Werner Cordes, Schulstrasse 26, 2165 Harsefeld; Roland Schneider, Gerngros Strasse 11, 8500 Nürnberg, both of Fed. Rep. of Germany

[21] Appl. No.: 759,198

[22] Filed: Jan. 13, 1977

[30] Foreign Application Priority Data

Jan. 20, 1976 [DE] Fed. Rep. of Germany ..... 2601885

[51] Int. Cl.[2] ..... B65B 5/00; B65B 39/00; B65B 53/02

[52] U.S. Cl. ..... 53/30 S; 53/35; 53/184 S; 53/258

[58] Field of Search ..... 53/26, 30 S, 35, 183, 53/187, 192, 184 S, 255, 257, 258, 260, 261, 242, 243

[56] References Cited

U.S. PATENT DOCUMENTS

| | | | |
|---|---|---|---|
| 797,753 | 8/1905 | Roth | 53/258 |
| 2,500,819 | 3/1950 | Hall et al. | 53/258 |
| 3,270,485 | 9/1966 | Knepper | 53/255 |
| 3,473,290 | 10/1969 | Culpepper | 53/392 |
| 3,585,778 | 6/1971 | Winstead | 53/257 |
| 3,788,463 | 1/1974 | Ruff | 53/30 S |
| 3,910,011 | 10/1975 | Beninger | 53/258 |

*Primary Examiner*—Robert Louis Spruill

[57] ABSTRACT

The invention relates to a method of, and apparatus for packing a plurality of separate articles in a single package surrounded by a cover of shrunk-on foil. In a preferred embodiment, the articles to be packed are stacked, in a first guide forming a shaft open at its upper end, upon a supporting base loosely fitted in the shaft, whereupon the first guide is enclosed in a cover of shrinkable foil closed at its upper end and the first guide is enclosed externally by a second guide, the first guide being then separated from the assembly comprising the articles, the supporting base, the foil cover and the second guide in such a way that relative to the first guide, the articles and the supporting base pass through the open end of the shaft while the second guide, the cover, the stack and the supporting base maintain their relative positions. This assembly is then passed to an oven to shrink the foil cover, before the second guide is removed from the finished package.

9 Claims, 5 Drawing Figures

Figure 1:
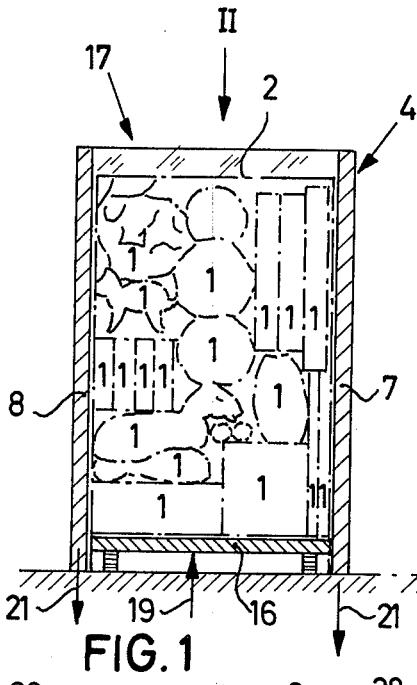

METHOD AND APPARATUS FOR PACKING A PLURALITY OF SEPARATE ARTICLES, IN A COVER OF SHRINKABLE FOIL

The invention relates to a method of packing a plurality of separate articles, in which the articles for packing are arranged in a stack which is then surrounded with a cover of shrinkable foil open on one side after which the cover is shrunk around the stack.

The invention also relates to apparatus for use in packing a plurality of separate articles in a cover of shrinkable foil.

It is known, in the case of uniformly or substantially uniformly shaped articles such as identical rectangular blocks, for the articles to be stacked on a pallet, then covered with a hood-shaped cover of heat shrinkable plastics foil, which is preferably turned inside out over the stack from above, after which the stack, closely surrounded with the hood of shrinkable foil is heated, together with the pallet, in an oven for example at approximately 200° C for half a minute and then cooled. As a result of the heating and subsequent cooling, the prestretched plastics foil, shrinks and adheres firmly in the desired manner to the outside of the stack.

Shrinkable foil packing of this kind has numerous advantages. For example, it protects the stack from the weather and from dirt during subsequent storage and transport. It also gives some protection against theft, since it is difficult to pilfer the stacked articles. Usually shrinkable foils are transparent, so that the articles can be inspected and their nature can be determined from the exterior.

The previously-described known method, however, is inadequate in the case of articles which cannot readily be stacked in a stable manner.

For example, in large warehouses for toys, a wide variety of articles may have to be placed together in a consignment and packed for despatch. The consignment may, for example, comprise cartons of widely varying size, balls, rings, bows and arrows, skittles etc., i.e. articles which cannot readily be stacked stably together. Theoretically in such cases it is possible to keep to the conventional method of packing the articles in re-usable containers such as lattice boxes or the like, which are subsequently returned empty after removal of the articles. This method, however, is uneconomic in applications in which articles have to be sent from a first place to a second place but comparable articles do not have to be sent from the second place to a third place (which would allow further utilization of the containers). In such cases a considerable number of empty containers are transported, which is uneconomical even with space-saving foldable containers, since even the empty folded containers have a considerable weight and volume. In such cases, furthermore, the previously partly-enumerated advantages of shrinkable foil packing are lost.

In another known method, the articles are stacked on a roller pallet which is partly surrounded by a guide frame covered on the inside with a shrinkable foil. There are guide walls on three of the four sides of the roller pallet, so that the pallet is easily accessible from the fourth side. However, this results in numerous disadvantages. Although good accessibility is very desirable, it is disadvantageous to have an exposed side in the case of very heterogeneous articles, since the articles can easily slip forward during or after stacking.

Another serious disadvantage of this known method is that it is relatively difficult or extremely laborious to cover the frame with a foil before stacking, since the shrinkable foil has to be held during stacking. It is also difficult to attach the shrinkable foil cover to the exposed fourth side after stacking and seal it by an upwardly extending seam, after which the top of the cover has to be suitably sealed. Clearly this known method is unsatisfactory.

It would apparently be much simpler if the foil did not have to be secured to the inside of the guide but was tensioned round the outside of the guide, since in this manner it would be easier to hold the foil during stacking. The drawback here is that the guide must not be covered by the shrinkable foil, since the guide is not to be despatched.

However, if the guide is covered and e.g. consists of substantially vertical spaced-apart struts, and if it is desired to withdraw the struts from the unit formed after shrinking, loose places result at the places previously occupied by the guide struts; at these places, the shrink foil does not adhere to the articles and thus cannot retain them. In addition, moisture and dirt can penetrate via the holes left by removal of the guide struts. A critical disadvantage of this method, however, is that the withdrawal of the guide is clearly likely to damage the shrink foil by tearing it at various places. This method, therefore, is unsuitable in practice.

An object of the invention is to improve the known methods and devices of the aforementioned kind, while avoiding their disadvantages, so that even heterogeneous articles can be reliably and efficiently packed in a shrinkable foil, thus retaining the advantages of shrinkable foil packing, without the foil being damaged e.g. by tearing. To ensure stable packing, the stack must be efficiently covered by the foil, particularly at its corner regions, and the packed articles must also be held in substantially optimum manner at the outer sides of the stack, without the articles moving substantially in the stack or relative to the shrink foil. Another important requirement is that the method and device according to the invention should require only a small working staff or should be substantially or completely mechanized or automatic.

According to one aspect of the invention there is provided a method of packing a plurality of separate articles in a single package comprising providing a cover of shrinkable foil, providing a guide having walls which together define a shaft within the guide, said shaft being open at one end, stacking the articles within said shaft, subsequently enclosing the guide in said cover of heat shrinkable foil whereby the cover surrounds said walls of the guide and extends across said open end of said shaft, subsequently separating the guide from the cover and the stack by effecting relative movement between the cover and stack on the one hand and the guide on the other hand, so that in relation to the guide, the stack is moved out of said open end of the shaft while maintaining its position with respect to the cover, a supporting force being applied to the end of the stack which prior to such movement was farthest from the open end of the shaft, and, subsequent to separation of the guide from the stack and cover, shrinking the cover around the stack.

According to another aspect of the invention, there is provided an apparatus for use in packing a plurality of separate articles in a cover of shrinkable foil, comprising a guide having walls which together define a shaft within the guide, said shaft being open at one end, support means within said shaft for supporting a stack of articles within the shaft and means for effecting relative movement between the guide and said support means in a sense to move the support means towards said open end of the shaft.

Preferred embodiments of the invention are described below with reference to the accompanying drawings.

Figure 3:
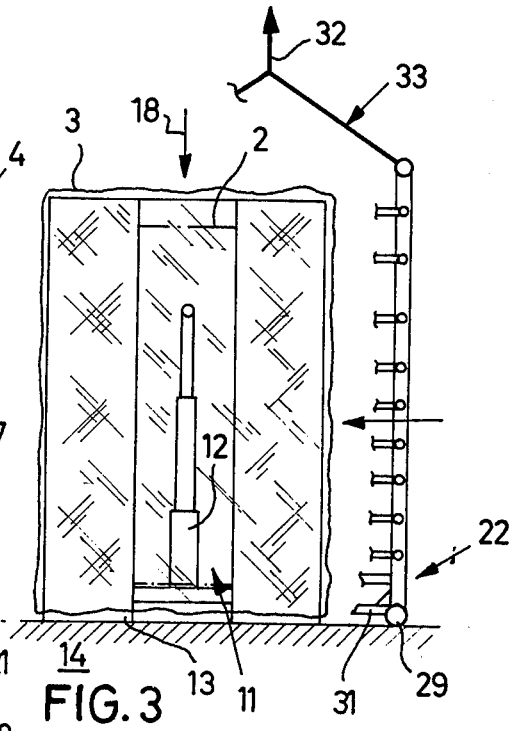
Figure 2:
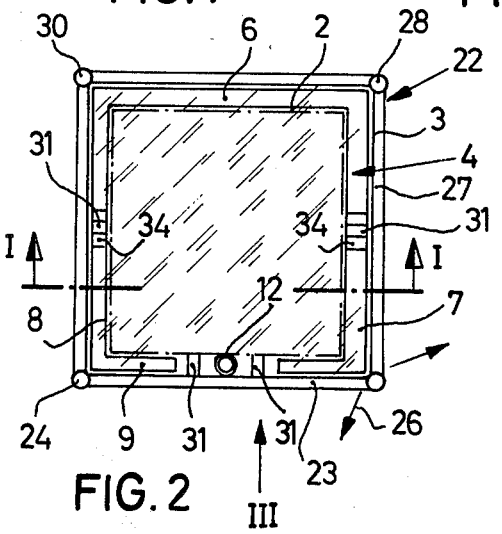
Figure 4:
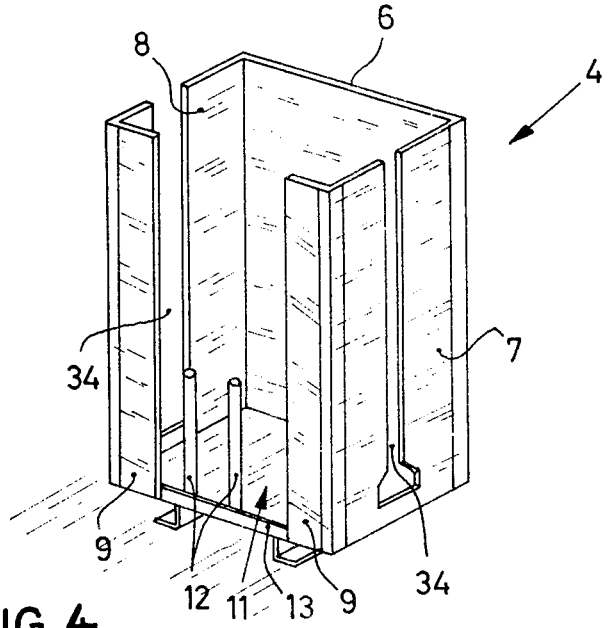
Figure 5:
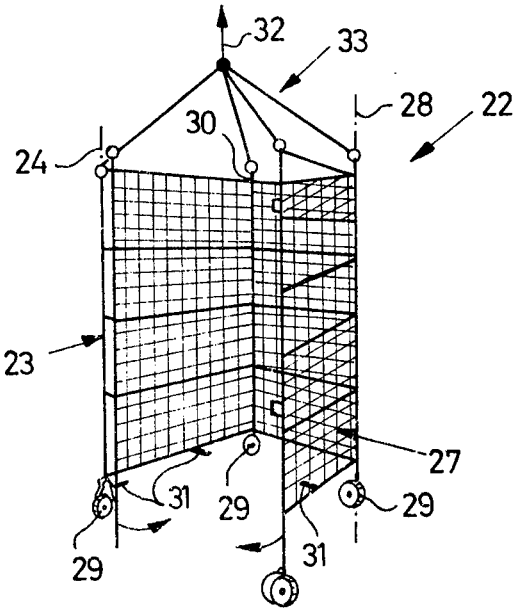

In the drawings:

FIG. 1 is a very diagrammatic view in vertical section, along the line I—I in FIG. 2, through a first guide having articles stacked therein FIG. 2 is a plan view looking in the direction of arrow II in FIG. 1, but showing in addition a hood of heat shrinkable foil and an outer or second guide, FIG. 3 is a side view corresponding to FIG. 2 looking in the direction of arrow III in FIG. 2, FIG. 4 is a simplified perspective drawing of the inner or first guide, and FIG. 5 is a simplified perspective drawing of the outer or second guide, partly unfolded.

In order to assist comprehension of the invention, the method according to the invention for packing a number of separate articles by means of shrink foil will now be described by way of example, with reference to the highly diagrammatic FIGS. 1, 2 and 3.

FIGS. 1 and 2 and 3 show separate articles 1, represented by chain-dotted lines. In the present case, the examples are parts of toys for making up a consignment in a wholesale toy warehouse. For this purpose, articles 1 are partly disposed side by side and partly one above the other, to form a stack 2 of articles as represented by a chain-dotted square in the drawings, which is to be covered with a cover 3 of heat shrinkable foil, which in FIGS. 2 and 3 is shown in the un-shrunk state before heating and subsequent cooling.

Since articles 1 vary widely and cannot easily be stacked, the stack 2 is formed inside a substantially shaft-like guide 4. Guide 4 has a rear wall 6, two side walls 7 and 8 and a front wall 9, which is formed with a central slot 11 to maintain lateral access to the interior of guide 4, so that it can be packed from the side. A telescopic rod guide 12 can also be provided, so as to have an additional guide means subsequently in the neighborhood of slot 11. At its bottom end, guide 4 is encircled by a frame 13.

In principle, guide 4 does not need to have a bottom, particularly in cases e.g. when the lowest layer of articles consists of a large cardboard box, at least part of which is at a distance from the underlying surface 14. If this is not so (and in other cases also), a loose base 16 is preferably inserted in the guide. The base can be a roller pallet as in the example in FIG. 1, or can be a stacking pallet or the like. In this manner, considerable portions of base 16 are at a distance from the underlying surface, which is important for the subsequent operations.

After the state shown in highly diagrammatic form in FIG. 1 is reached, the outside of walls 6, 9 and preferably the top 17 of guide 4 are covered with shrink foil, preferably by inverting or pulling a shrink foil hood from above over guide 4 in the direction of arrow 18 in FIG. 3. This method ensures that the shrink foil hood 3 stays in position without the use of auxiliary devices such as clamps, that it does not need to be closed along a longitudinal seam, and that the top of the shrink foil is already closed.

Before foil 3 is heated, the underside of stack 2 or base 16 is subjected to a bearing force as indicated by arrow 19 in FIG. 1, and at the same time or immediately afterwards guide 4 is moved relative to stack 2 and hood 3, until guide 4 is completely separated and stack 2 is directly surrounded by hood 3. In principle, guide 4 can be pulled downwards in the direction of arrows 21; alternatively, stack 2, foil 3 and the base 16, if present, can be pushed upwards, or the guide 4 can be pulled downwards while the stack 2, foil 3 and base 16, if any, are simultaneously pushed upwards.

The methods described above, without the elaboration to be described next, are recommended only in cases when the articles 1 are particularly light conveyed articles which are held together sufficiently firmly by shrinkable foil 3, even before shrinkage, or if foil 3 is sufficiently thick and adheres sufficiently closely to stack 2. Usually this is not the case, particularly in view of tolerances between different packages, or else excessive manipulation is required.

For this reason, while basically retaining the previously-described method, an additional step is preferably introduced before guide 4 is separated. The effect of this additional step is that the shrinkable foil hood is, as it were, "transferred" from the outside to the inside of the guide (which it is not desired to include in the package) with the result that an excellent guiding and bearing effect is provided up to the end of the shrinkage process, but after the shrinkage the guide can easily be withdrawn, i.e. in simple manner without causing damage.

Since shrink foil 3 cannot in fact be "transferred" in this way, in order to achieve the same effect, the guide 4, after being surrounded on its outside by foil 3, is replaced by a guide 22, surrounding the stack and the foil 3 thus obtaining the desired object in almost ideal manner.

To this end, after guide 4 has been covered with hood 3, the aforementioned second guide 22 is placed in position. Guide 22, like the other guide, is substantially shaft-shaped and dimensioned so that its unobstructed internal dimensions are only slightly greater than the outer dimensions of the first guide 4. Guide 22 has apertures so that, when the assembly comprising guide 22, the stack and the foil 3 is subsequently heated, the heat can flow through these apertures and act on foil 3. Advantageously, to this end, guide 22 is constructed as a lattice frame having walls which are at least partly pivotable relative to one another, so that guide 22 can in simple and advantageous manner be placed around the first guide 4 surrounded by foil 3.

For example, the front wall 23 of the second guide 22 is pivotable around the vertical axis 24 in the direction of arrow 26, whereas the side wall 27 of guide 22 is pivotable around the vertical axis 28. Since the lattice frame acting as the second guide 22 is movable on rollers 29 (one such roller being shown in FIG. 3), guide 22 can very easily be driven up to guide 4 and folded around it. Of course, the corner axis 30 can also be a pivot axis, thus making guide 22 still easier to handle.

In this embodiment of the method and apparatus, the bearing force indicated by arrow 19 in FIG. 1 can be applied by the second guide 22, i.e. by providing the lower portion of guide 22 with a bearing device. The bearing device preferably comprises projections 31 which, when guide 22 is placed around the first guide 4 and the shrinkable foil 3 automatically fit under stack 2 or under the loose base 16, if present. If the first guide 4 is separated from stack 2 and hood 3 by moving the stack or hood upwards and holding guide 4 in its initial position, the described device can be used for this purpose e.g. by moving the second guide 22 upwards in the direction of arrow 32, using lifting gear 33 and a lifting device (not shown), during which time the first guide 4 is prevented from moving upwards. Since projections 31 fit under base 16 and consequently under stack 2, the lifting device lifts not only the lattice frame 22, which of course is locked in the position shown in FIG. 2, but also lifts base 16, articles 1 or 2 stacked on base 16, and hood 3 secured over stack 2. Only the first guide 4 remains in position, as was intended.

Thereupon, stack 2 is directly surrounded by hood 3, as is also intended. At the same time, stack 2 including hood 3 is supported in optimum manner by the second guide 22. In addition, guide 22, owing to its lattice construction, allows free passage to the heat during the subsequent heating operation.

For the purpose of heating, the unit comprising parts 22, 3, 2 and 16 is moved into an oven (not shown in the drawing) and heated. Next, the same unit is moved out of the oven and allowed to cool, whereupon foil 3 shrinks and adheres closely to the articles 1 of stack 2, and also shrinks into the corner regions under base 16, thus ensuring excellent stability.

It should be noted that the previously-described method i.e. the application of bearing forces by projections 31 in the direction of arrow 19, can be achieved only by providing slots 34 (see FIG. 2) in the side walls 7, 8 of the first guide 4, the slots beginning at a distance from the bottom end portion and extending to the top edge of the first guide 4. In this manner, projections 31 can lift stack 2, which is on the roller pallet, stack pallet or the like 16, upwards out of the first guide 4.

When using standard pallets, e.g. 120 cm long and 80 cm wide, articles 1 must be prevented from projecting sideways during stacking, over the pallet forming the loose base 16. This is likely to be unavoidable, in view of the required mutual spacing and tolerances. To prevent this happening, according to a preferred feature, the side walls 6 – 9 of the first guide 4 taper slightly upwards in pyramidal manner and are constructed so that they can be moved to a limited extent relative to one another. For example, the internal dimensions of the first guide 4 at the upper end 17 can be 115 × 75 cm instead of 120 × 80 cm. This ensures that only the bottom portion of stack 2 can project slightly over the pallet, but this can be avoided by suitable packing, whereas further upwards the stack is automatically prevented from projecting. In that case, when the first guide 4 is moved away, its walls open outwards, so that the larger base 16 (e.g. the stacking pallet) can move upwards through guide 4, together with the articles on it.

I claim:

1. A method of packing a plurality of separate articles in a single package, comprising: providing a cover of heat shrinkable foil, providing a first guide having walls which together define a shaft within said first guide, said shaft being open at one end, stacking said articles within said shaft, subsequently enclosing said first guide in said cover of heat shrinkable foil, whereby said cover surrounds said walls of said first guide and extends across said open end of said shaft, subsequently placing a second guide around said first guide, said second guide extending around the outside of said cover and being maintained in a position relative to said cover and said stack while subsequently separating said first guide from said cover, from said stack, and from said second guide by effecting relative movement between said first guide on the one hand and said cover, said stack, and said second guide on the other hand, so that in relation to said first guide, said stack is moved out of said open end of said shaft while maintaining its position with respect to said cover and said second guide, a supporting force being applied to said stack, and, subsequent to separation of said first guide from said stack and said cover, shrinking said cover around said stack.

2. The method of claim 1, in which said second guide is removed only after said cover has been shrunk around said stack.

3. The method of claim 1, in which said stack, said cover, and said second guide are withdrawn upwards from said first guide.

4. The method of claim 1, in which said first guide is withdrawn downwards from said stack, said cover, and said second guide.

5. Apparatus for use in packing a stack of separate articles in a cover of heat shrinkable foil, comprising: a first guide having walls which together define a shaft within said first guide, said shaft being open at one end, further including a second guide adapted to be placed around said first guide and having walls which, when said second guide is placed around said first guide, lie close to and parallel with the walls of said first guide, support means connected to said second guide and extending into said shaft for supporting said stack when said second guide is placed around said first guide, and means for separating said first guide from said stack, said cover, and said second guide.

6. The apparatus of claim 5, in which said second guide is in the form of a frame, defining apertures in said walls of said frame.

7. The apparatus of claim 5, in which said support means are support members in the form of projections for supporting said stack of articles and are provided at a bottom portion of said second guide, said projections being adapted to project into said shaft, and in which said separating means comprises lifting means for lifting said second guide.

8. The apparatus of claim 7, in which said projections are each disposed at a distance from the corners at which the walls of said second guide meet.

9. The apparatus of claim 5, in which the walls of said first guide converge slightly towards said open end of said shaft.

* * * * *